United States Patent [19]

Iizuka

[11] Patent Number: 4,815,723

[45] Date of Patent: Mar. 28, 1989

[54] PHOTOSENSITIVE PLATE AUTOFEEDER

[75] Inventor: Shinji Iizuka, Kanagawa, Japan

[73] Assignee: Fuji Photo Film Co., Ltd., Kanagawa, Japan

[21] Appl. No.: 111,329

[22] Filed: Oct. 22, 1987

[30] Foreign Application Priority Data

Oct. 22, 1986 [JP] Japan ..... 61-249423
Jan. 7, 1987 [JP] Japan ..... 62-1475

[51] Int. Cl.[4] ..... B65H 5/08

[52] U.S. Cl. ..... 271/14; 271/11; 271/107

[58] Field of Search ..... 271/11, 12, 10, 107, 271/108, 269, 149, 265, 14; 414/330, 124, 130

[56] References Cited

U.S. PATENT DOCUMENTS 2,402,048 6/1946 Hyde et al. ..... 271/10
2,621,928 12/1952 Lauffer ..... 271/12
2,652,248 9/1953 Johnson ..... 271/149
3,754,751 8/1973 Capetti et al. ..... 271/108

FOREIGN PATENT DOCUMENTS 375260 12/1930 United Kingdom ..... 271/11
711223 6/1954 United Kingdom ..... 271/10

OTHER PUBLICATIONS

Howe, IBM Technical Disclosure Bulletin, Automatic Vacuum Feed Hopper, Jul. 1976, vol. 19, No. 2, p. 442.

*Primary Examiner*—H. Grant Skaggs
*Attorney, Agent, or Firm*—Sughrue, Mion, Zinn, Macpeak & Seas

[57] ABSTRACT

An autofeeding apparatus for automatically transporting exposed photosensitive plates, which may be of different sizes, one by one from a nearly vertical stack to an automatic developing station. The photosensitive plates are placed in a vertical stack on a stack holder, and a supporting device disposed opposite the holder supports the lower ends of the plates. A transport device transfers the lower end of the uppermost one of the photosensitive plates from the holder to the supporting device. A separating device separates the uppermost plate from the holder. A lifting device, driven separately from the separating device, lifts the supporting device to feed the uppermost plate to the automatic developer with the upper end of the plate at the head.

14 Claims, 7 Drawing Sheets

PHOTOSENSITIVE PLATE AUTOFEEDER

BACKGROUND OF THE INVENTION

The present invention relates to an autofeeding apparatus for automatically transporting exposed photosensitive plates for developing by an automatic processing or developing machine. More particularly, the invention relates to a photosensitive plate autofeeder which can stack a plurality of photosensitive plates and then feed the photosensitive plates one by one to the automatic processing machine in such a manner as to insert the photosensitive plates one by one into the automatic processing machine.

For continuously processing a large number of photosensitive plates (formed by coating one or both sides of a support, such as an aluminum support, a stainless steel support, a paper support, a plastic support or the like, with a photosensitive layer having a solubility which changes upon irradiation with light) with an automatic processing machine, a photosensitive plate autofeeder connected to the automatic processing machine has been used. The photosensitive plates are transported by rollers or the like. The automatic processing machine or developer has a developing zone, and may also include a washing zone, a gumming zone, a drying zone, and the like.

In a conventional photosensitive plate autofeeder, after exposure a plurality of photosensitive plate are stacked horizontally on a stand provided at the photosensitive plate entrance of the automatic processing machine, and suction cup devices are applied to the photosensitive plates from the top to hold and feed the plates one by one to the automatic developer.

However, this photosensitive plate autofeeder requires a considerably large area for housing the horizontally stacked plates in the case where large photosensitive plates, such as PS-size plates or the like having an 800 mm width and a 1050 mm length, are processed.

Moreover, it is difficult with the conventional photosensitive plate autofeeder to accommodate photosensitive plates of different sizes for continuous processing. For example, in the case where a photosensitive plate of a different size from the one currently being processed is received just behind the current plate, the operation of the autofeeder must be halted, and then the differently sized plate fed manually to the plate entrance of the automatic processing machine.

SUMMARY OF THE INVENTION

Upon consideration of the aforementioned circumstances, an object of the present invention is to provide a photosensitive plate autofeeder which is easy to handle, with which photosensitive plates can be efficiently fed to an automatic processing machine, and for which only a small installation space required.

In order to attain the foregoing object, according to one aspect of the present invention, a photosensitive plate autofeeder for feeding exposed photosensitive plates to an automatic processing machine includes: a photosensitive plate stack holder for holding a plurality of substantially vertically arranged photosensitive plates; photosensitive plate transferring means for grasping a lower end portion of an upper most photosensitive plate in the vertical stack and successively transferring the photosensitive plates one by one from the stack to photosensitive plate separating means; detecting means for detecting separation of said upper most photosensitive plate; and photosensitive plate conveying means for conveying the photosensitive plate to the automatic processing machine along a photosensitive plate guiding means in response to the detection of the release of the photosensitive plate from by the transferring means.

According to another aspect of the present invention, a photosensitive plate autofeeder for feeding exposed photosensitive plates to an automatic processing machine is provided comprising: a photosensitive plate stack holder for holding a plurality of substantially vertically arranged photosensitive plates; supporting means disposed in opposition to the stack holder for supporting a lower end of the photosensitive plate; transferring means for transferring the lower end of the uppermost one of the photosensitive plates from the stack holder to the supporting means; separating means which is lifted between the supporting means and the stack holder for separating the uppermost one of the photosensitive plates from the holder; and photosensitive plate conveying means driven separately from the separating means for conveying the uppermost photosensitive plate separated from the stack holder to the automatic processing machine with the upper end of the photosensitive plate at the head by lifting the supporting means.

According to the present invention, a plurality of exposed photosensitive plates are stacked on the holder, and the lower end of the uppermost one of the photosensitive plates is lowered onto the supporting means by the transferring means. In this condition, the separating means is lifted between the supporting means and the holder so that the photosensitive plate, having its lower end on the supporting means and its upper end on the holder, is gradually separated from the stack holder with its lower end at the head as the separating means is lifted.

In this condition, the photosensitive plate conveying means lifts the supporting means so that the upper end of the photosensitive plate is fed to the automatic processing machine. Thus, the plurality of photosensitive plates stacked on the stack holder can be fed one by one to the automatic processing machine starting from the uppermost plate.

As described above, the separating means is operated independently of the conveying means. Accordingly, the lower end of the photosensitive plate can be securely supported by the supporting means while the uppermost one of the photosensitive plates is being separated from the stack holder by the separating means. Therefore, it is not necessary for the photosensitive plate to be continuously retained by the transferring means, which is composed of suction cups and related parts, during this time period.

Further, according to the invention, the supporting means can be returned to its original position for supporting the next photosensitive plate immediately after the conveying means lifts the supporting means to convey or feed the upper end of the photosensitive plate to the automatic processing machine. Accordingly, the time required for feeding one photosensitive plate to the automatic developer or processing machine is shortened.

DESCRIPTION OF THE PREFERRED EMBODIMENTS

Preferred embodiments of the present invention will be described hereinafter in detail.

Figure 1:
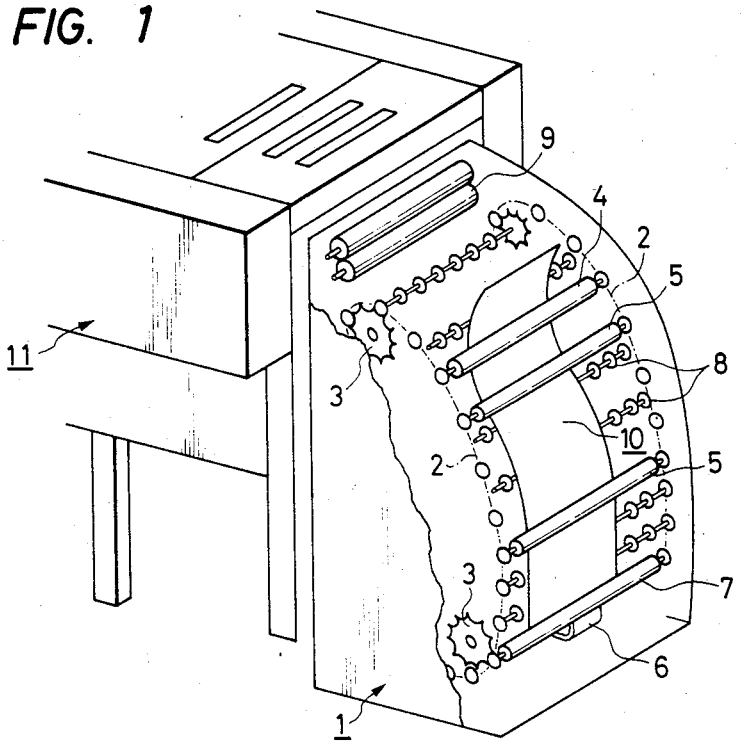
FIG. 1 is a partly cut-away perspective view of a preferred embodiment of a photosensitive autofeeder according to the first embodiment of the present invention.
Figure 2:
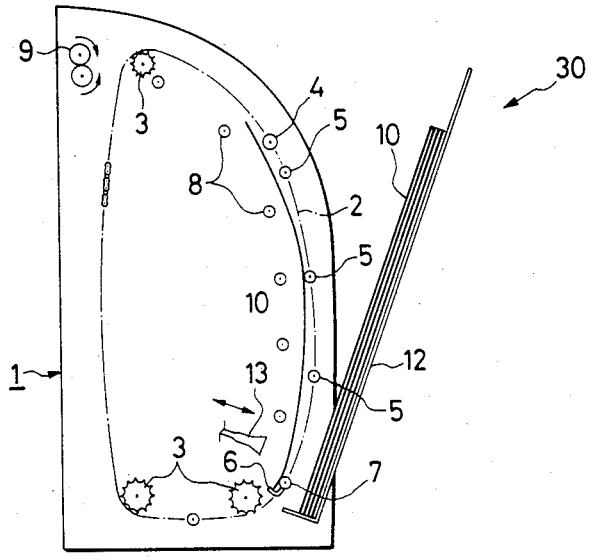
FIG. 2 is a schematic side view of the photosensitive autofeeder depicted in FIG. 1.

FIGS. 1 and 2 are, respectively, a partly broken perspective view and a schematic side view of a preferred embodiment of a photosensitive plate autofeeder 30 constructed according to the present invention.

Figure 5A:
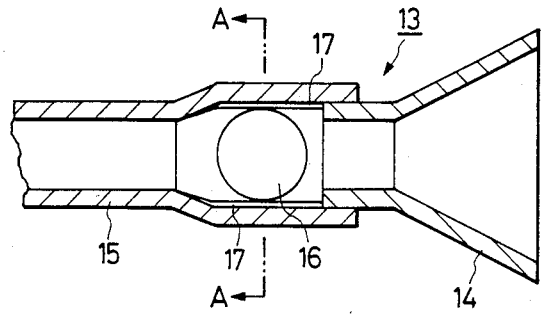
FIG. 5A shows the opened portion of the grasping device in this embodiment in longitudinal section.
Figure 5B:
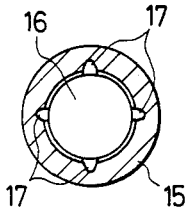
FIG. 5B shows the top end portion of the grasping device in a cross-sectional view taken along a line A—A in FIG. 5A.

As shown in FIGS. 1 and 2, the photosensitive plate autofeeder 30 of the present invention has photosensitive plate separating and feeding means 1 and a photosensitive plate stack holder 2. The autofeeder 30 has a pair of vertically entrained chains 2, sprockets 3 linked to a driving device for driving the chains, leading and intermediate roller 4 and 5 supported by the chains 2 at their opposite ends to form a photosensitive plate separating device, a rear supporting portion 7 provided with a force hook 6, a plurality of rotatably fixed rollers 8 provided in the direction of conveying the photosensitive plate 10 to form photosensitive plate guiding means, a pair of upper and lower insertion rollers 9 for inserting the photosensitive plate 10 into an automatic processing machine 11, a photosensitive plate stack holder 12 for vertically holding a plurality of photosensitive plates 10, and grasping device 13, provided with suction cups 14 (see FIGS. 5A and 5B) for transferring the photosensitive plates 10 one by one into the conveying system of the autofeeder from the photosensitive plate stack holder 12.

The rotatably fixed rollers 8, which form the above-mentioned photosensitive plate guiding means, are provided to support the rear surface of the photosensitive plate 10. The plate guiding means or slide supporting portion has a convex surface so as to suitably expand toward the photosensitive plate stack holder 12, and the upper end thereof is arranged to oppose the pair of insertion rollers 9 provided at the plate entrance to the automatic processing machine 11.

As described above, the plate conveying system is composed of the chain 2, the intermediate rollers 5, and the rear supporting portion 7 having the force hook 6. The plate conveying system is vertically movable along the plate guiding means. More particularly, the chains 2 are linked to the sprockets 3 driven by a driving device (not shown). The chains 2 are supported by a plurality of rototable sprockets arranged at suitable intervals along the plate guiding means, and, if necessary, by the sprockets and also guides. A supporting bar (not shown) horizontally interposed between the chains in the vicinity of the leading roller 4 is provided with a sensor, such as a photoelectric detector or the like, for detecting the top end of the photosesitive plate 10. The rear supporting portion 7 is provided with the force hook 6 composed, for example, of a plurality of U-shaped hooks, for lifting up the photosensitive plate 10.

The photosensitive plate holder 12 is attached at the front of the photosensitive plate separating and feeding means 1 so that the back surface of the photosensitive plate feeding holder 12 forms an acute angle relative to the vertical direction. A grasping device 13 having at least two suction cups 14 at its ends is aligned in the widthwise direction of the photosensitive plate 10 and arranged so as to be movable perpendicularly relative to the bottom surface of the photosensitive plate stack holder 12. Each of the suction cups 14 can attach itself by suction and hold the photosensitive plate 10 by a negative pressure generated by a suction pump (not shown).

The operation of the aforementioned photosensitive plate autofeeder 30 will now be described in detail.

A plurality of photosensitive plates 10 to be processed are set in the photosensitive plate stack folder 12. In placing the plate 10 on the stack holder 12, it is preferable to align the edges of the photosensitive plates 10 along one side if any of the photosensitive plates 10 are of different sizes.

Next, the suction cups 14 perpendicularly approach the photosensitive plates 10 set in the photosensitive plate stack holder 12 and attach themselves to the photosensitive plates 10 to thereby lift the lower end of the uppermost photosensitive plate 10 out of the photosensitive plate stack holder 12 to transfer the uppermost photosensitive plate 10 to the photosensitive plate guiding means. At this time, the leading roller 4, acting as one member of the separating device, is located at a position below the suction cups 14. A detecting device 19 senses whether the photosensitive plate 10 has been properly grasped. Various kinds of detecting devices, for example, a microswitch, a photosensor, or the like, can be used for the detecting device 19.

Figure 3:
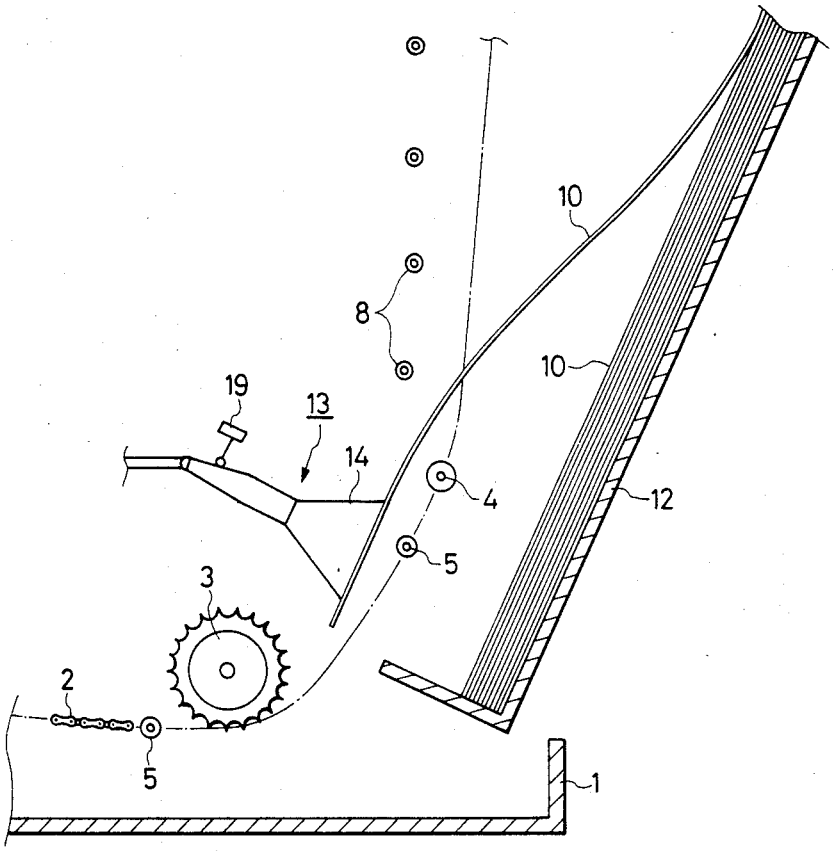
FIGS. 3 and 4 are schematic side views showing an operation in the vicinity of the grasping device provided in this embodiment.
Figure 4:
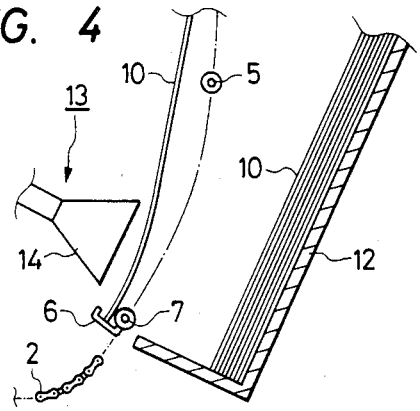

Next, the sprockets 3 (shown in FIG. 3) are rotated in response to the grasping detection signal so that the chains 2 move upward. At this time, the leading roller 4, acting as one member of the separating device, moves under the lifted photosensitive plate 10. As the sprockets 3 are further rotated, the intermediate rollers 5 move in the same manner as the leading roller 4. Thus, one photosensitive plate 10 is placed between the rotatably fixed rollers 8 and the aforementioned rollers 4 and 5 so that it is separated from the photosensitive plate stack holder 12. When the leading roller 4 reaches the upper end of the photosensitive plate 10, the upper end of the photosensitive plate 10 is detected by the separation detecting device installed on the supporting bar extending horizontally between the chains in the vicinity of the leading roller 4. The rotation of the sprockets 3 is halted in response to a separation completion signal and then the rotation of the sprockets 3 is reversed until the upper end of the photosensitive plate 10 projects past the leading roller 4 by several centimeters. After reverse rotation of the sprockets 3, the suction is released (as indicated in FIG. 4), whereupon the rear edge of the plate is held by the U-shaped force hook 6 located in the vicinity of the lower end of the photosensitive plate 10.

To release the suction, any suitable arrangement may be used. For example, an electromagnetic valve may be provided in the suction path so that the pressure in the suction passage can be equalized to atmospheric pressure by opening the electromagnetic valve, or, for example, the operation of the suction pump may be halted directly. The sprockets 3 are then turned again so that the photosensitive plate 10, supported at its rear edge by the force hook 6, is conveyed to the position where its top end is placed between the insertion rollers 9.

Upon detection of the fact that the top end of the photosensitive plate 10 has been sandwiched between the insertion rollers 9, the rotation of the sprockets 3 is halted then immediately reversed to position the chains 2 in their standby position in which the leading roller 4 is located below the suction cups 14.

With the respect to the device detecting the fact that the top end of the photosensitive plate 10 has been sandwiched between the insertion rollers 9, a slight shock generated on the photosensitive plate 10 when the plate is sandwiched between the insertion roller 9 may be detected by a shock detecting device providing in the force hook 6, by the use of the fact that the conveying speed of the chains 2 is higher than the peripheral speed of the insertion rollers 9. The shock detecting device may be, for example, a microswitch or the like, or a sensor such as a photoelectric detector disposed in the vicinity of the insertion rollers 9.

Finally, the photosensitive plate 10 sandwiched between the insertion rollers 9 is fed into the plate conveying system of the automatic processing machine 11.

By repetition of the aforementioned procedure the autofeeder 1 can feed a plurality of photosensitive plates 10 one by one into the automatic processing machine.

The construction of the top end portion of the grasping device 13 in this embodiment is shown in FIG. 5. The grasping device 13 used in the present invention has a suction cup 14, piping 15 including a suction-cup attaching portion, a ball 16, and at least one axial groove 17 provided in the inner surface of the attaching portion. More particularly, the piping 15 has one end connected to a suction or vacuum pump and the other enlarged to form an attaching portion. The small-sized portion of the suction cup 14, which may be made of rubber or plastic resin, is inserted into the enlarged attaching portion of the piping 15. For example, four axial grooves 17 can be axially formed in the inner surface of the suction-cup attaching portion. The ball 16, which has a diameter slightly smaller than the inner diameter of the attaching portion, is inserted into the attaching portion. Preferably, the grooves are formed so that the depth of each of the grooves increases toward the forward end.

The ball 16 is sucked toward the pump side (the innermost portion of the attaching portion) when the suction pump is operated, but the air within the attaching portion is pulled through the grooves 17 to generate a negative pressure in the throat of the suction cup 14 to thereby make it possible for the suction cup to attach itself to the photosensitive plate 10. When attachment has been effected to the photosensitive plate 10, the passages on the opposite sides of the ball 16 are approximately equalized in negative pressure, and hence the ball 16 becomes free, thereby completing the suction grasping of the photosensitive plate 10.

On the other hand, even if the photosensitive plate 10 is so small that all of the suction cups 14 cannot contact the surface of the plate, the leakage of air from the suction cups 14 which cannot contact the surface of the plate is slight because the ball 16 remains sucked against the innermost portion of the attaching portion. In other words, the ball 16 is attracted to the innermost portion of the suction cup attaching portion, thereby preventing leakage, except for a small amount from the slight gaps of the grooves 17. As a result, the other suction cups 14 grasping the photosensitive plate 10 can maintain their suction forces.

Accordingly, when the grasping device of the present invention, is used, small-sized photosensitive plates 10 can be securely grasped, even when the suction cups 14 are arranged based on the largest-sized photosensitive plates 10. Further, even in the case where the photosensitive plates 10 stacked in the photosensitive plate stack holder 12 are of different sizes, all such photosensitive plates can be securely grasped.

Although the aforementioned embodiment has been described with respect to the case where the chains 2 are used for stopping/moving the leading and intermediate rollers 4 and 5 and the rear supporting member 7, it is to be understood that the invention is not limited to this specific embodiment, that is, the chains 2 may be replaced by rubber belts or the like. Further, the rotatably fixed rollers for supporting the moving photosensitive plate from the rear thereby may be replaced by brushes or the like.

As described above, the autofeeder according to the present invention is constructed so that the photosensitive plates can be nearly vertically stacked. Accordingly, the space required for stacking the photosensitive plates is substantially reduced compared with the conventional autofeeder. Further, the autofeeder according to the invention has photosensitive plate grasping devices of relatively simple construction with which photosensitive plates can be securely grasped, even when the photosensitive plates are of different sizes.

Subsequently, another embodiment of the present invention will be described in detail with reference to FIGS. 6 and 7.

Figure 6:
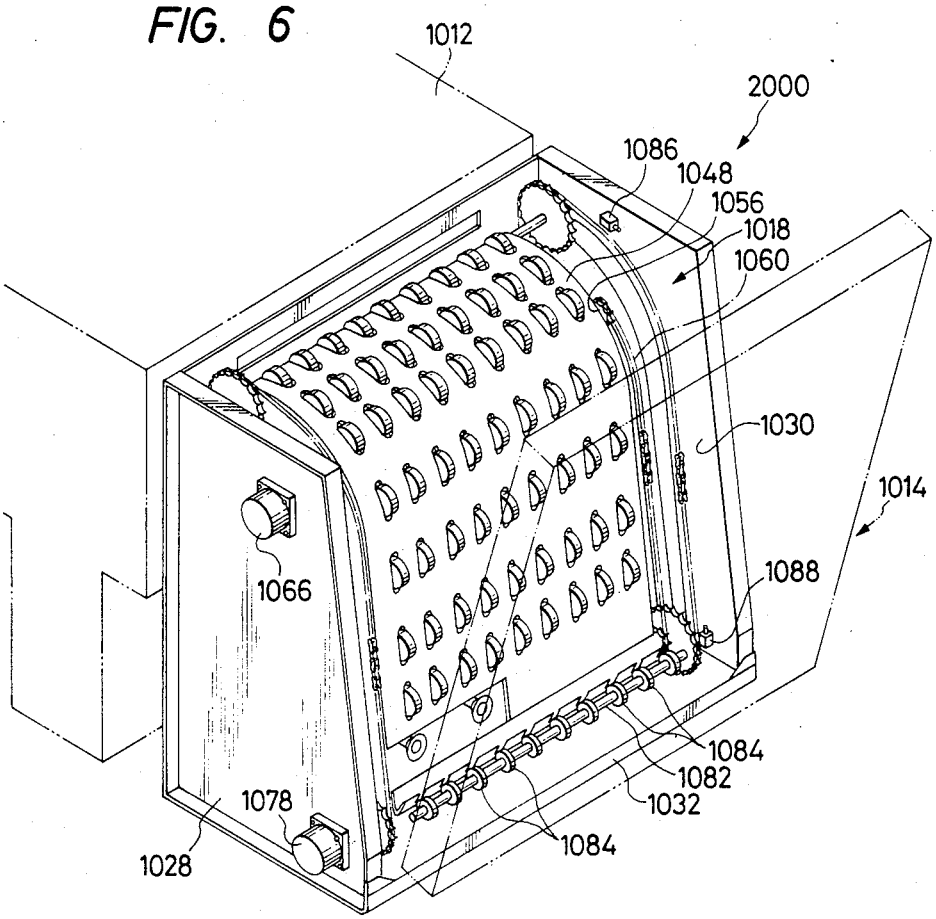
FIG. 6 is a perspective view showing another embodiment of the present invention.
Figure 7:
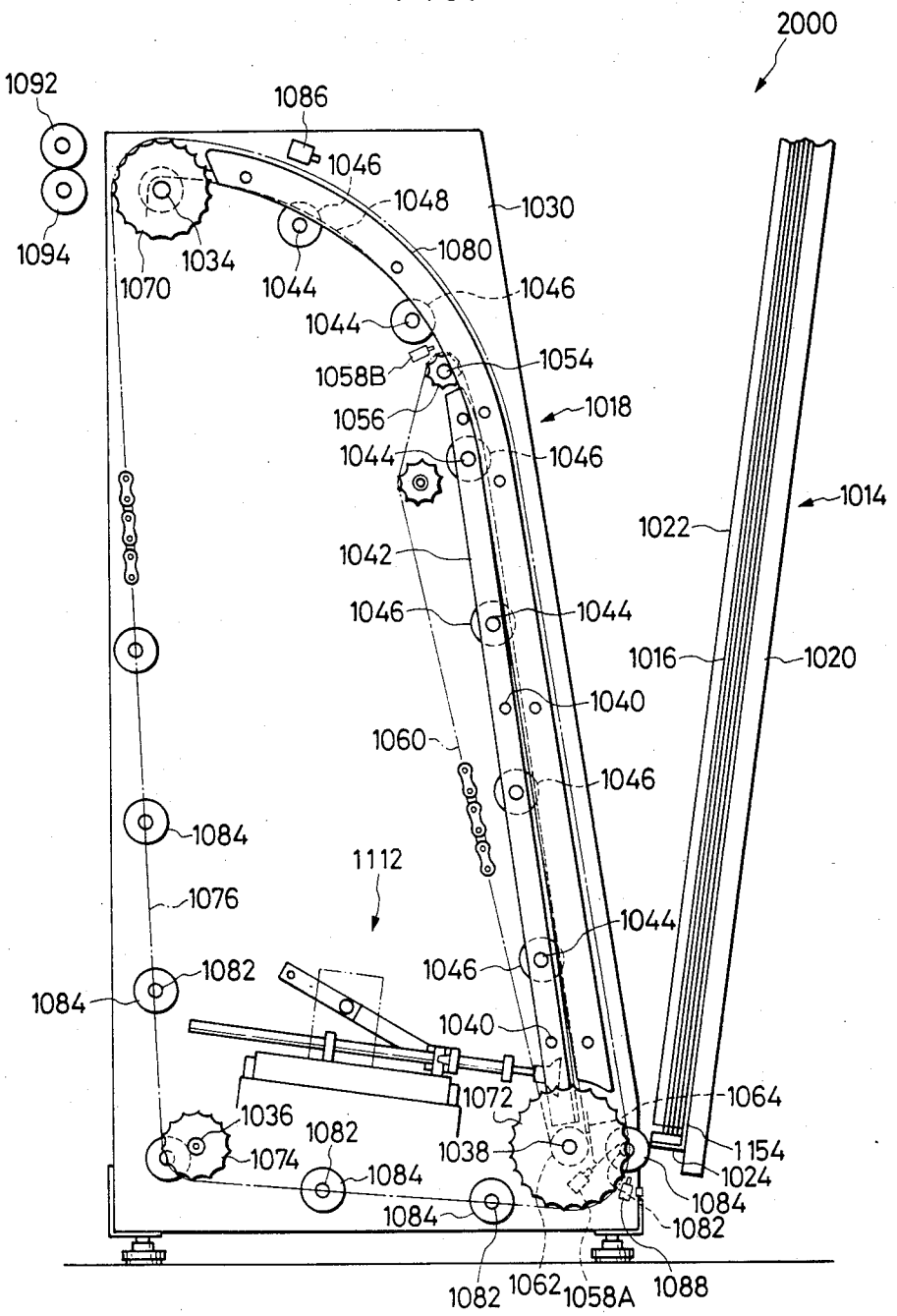
FIG. 7 is a side view of FIG. 6.

FIG. 6 and 7 show the condition where the photosensitive plate autofeeder 2000 according to the invention is connected to an automatic processing machine 1012. In this embodiment, the photosensitive plate autofeeder 2000 has aninclined stack holder 1014 for substantially vertically stacking a plurality of photosensitive plates 1016 which have been exposed to light in another process. The photosensitive plates 1016 stacked on the stack holder 1014 can be fed one by one to the automatic processing machine 1012 by a separatinglifting device 1018.

The stack holder 1014 is constituted by a frame plate 1020, side plates 1022 (the front-side side plate 1022 not being shown in FIG. 7) and a supporting plate 1024. The side plate 1022 and supporting plate 1024 respectively project from the sides and the lower end of the frame 1020 so that the lower ends of the exposed photosensitive plates 1016 can be successively placed on the supporting plate 1024 from the frame plate 1020. The inclination angle of the frame plate 1020 relative to the vertical is about 8 degrees. The photosensitive plates 1016 after exposure can be stacked one upon the other so as to be piled from right to left in FIG. 7. Accordingly, the uppermost one of the photosensitive plates 1016 faces a photosensitive plate separating-feeding means 1018. In this embodiment, it is preferable that the photosensitive layers of the photosensitive plates 1016 are placed far from the separating-feeding means 1018 in case that the photosensitive plates have the photosensitive layer on one side of its support.

Figure 8:
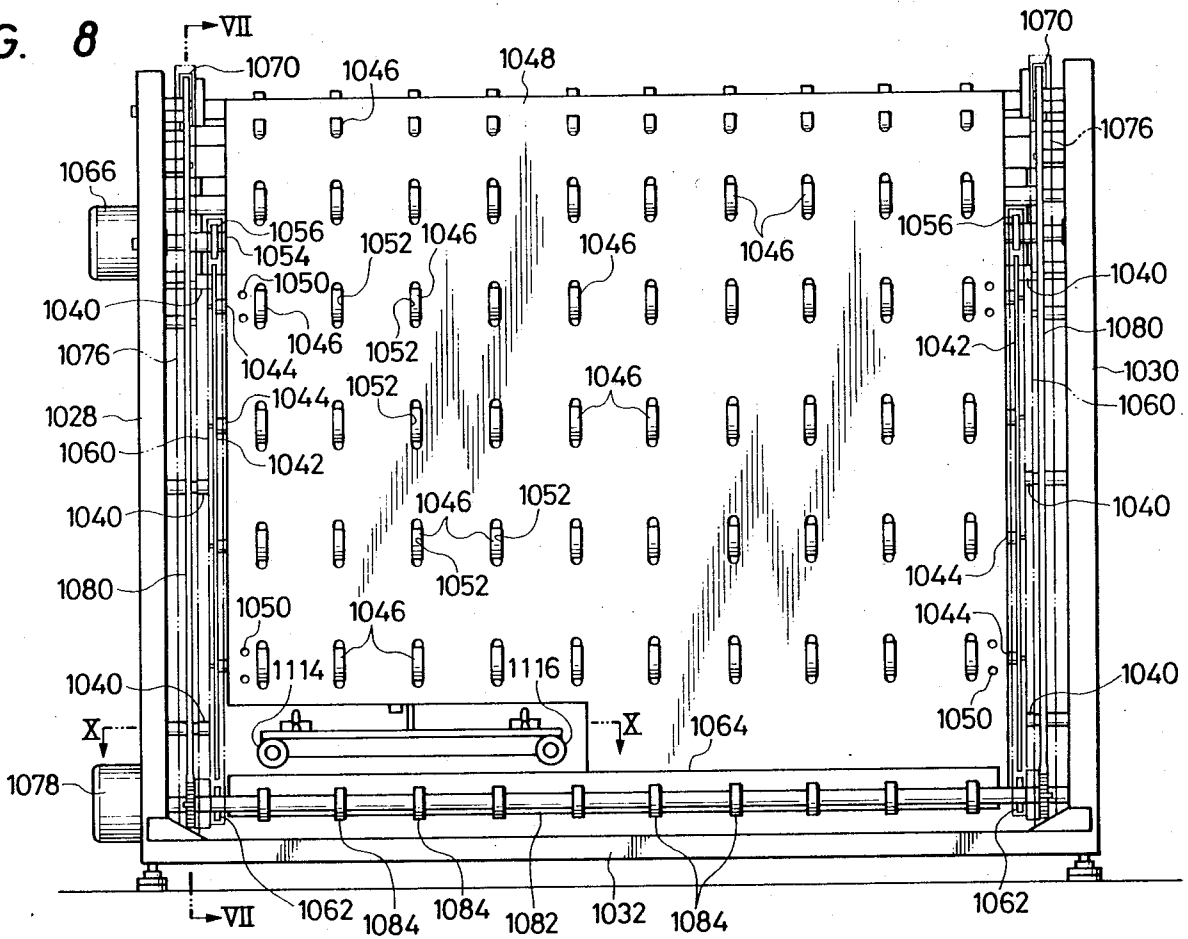
FIG. 8 is a front view showing a condition where the stack holder of FIG. 6 is removed.

The separating-feeding means 1018 is provided with a pair of side boards 1028 and 1030 which extend substantially vertically at both sides, as shown in FIG. 8. The lower portions of the side boards 1028 and 1030 are connected together through a bottom board 1032. As shown in FIG. 7, the side boards 1028 and 1030 are connected via a shaft 1034 at their upper end portions and by shafts 1036 and 1038 at their lower end portions, so that the side boards 1028 and 1030 are held parallel to each other.

Props 1040 projecting from the facing sides of the side boards 1028 and 1030 are provided with inner guide boards 1042 fixed to the top ends of the prop 1040. Accordingly, the inner guide boards 1042 are mounted parallel to the side boards 1028 and 1030 and connected together through a plurality of shafts 1044.

A plurality of rotatable fixed rollers 1046 are rotatably fixed to the shafts 1044 at equally spaced points. Accordingly, the photosensitive plate 1016 separated from the stack holder or mount 1014 can be supported by the plurality of rotatably fixed rollers or guide rings 1046 at a reverse angle to that of the plate 1016 supported by the stack holder 1044 with respect to the vertical axis.

A supporting board 1048 is attached to the shafts 1044 by screws 1050 and is provided with a plurality of notches 1052 for projecting the guide rings 1046 partly toward the stack holder 1044. Accordingly, the photosensitive plate 1016 supported by the rotatably fixed rollers 1046 cannot slip to the left of the rotatably fixed rollers 1046 in FIG. 7.

A rotary shaft 1054 is pivotally supported between the side boards 1028 and 1030 and disposed between secondary and tertiary upper shaft 1044 so as to be parallel to the shafts 1044. Sprocket wheels 1056 are mounted on the rotatry shaft 1054. The sprocket wheels 1056 are disposed above the inner guide boards 1042 and engaged by respective inner chains 1060. The inner chains 1060 are extended to sprocket wheels 1062 mounted on the shaft 1038 so that the inner chains 1060 can be moved along the surfaces of the inner guide boards 1042 between the sprocket wheels 1056 and 1062.

Figure 12:
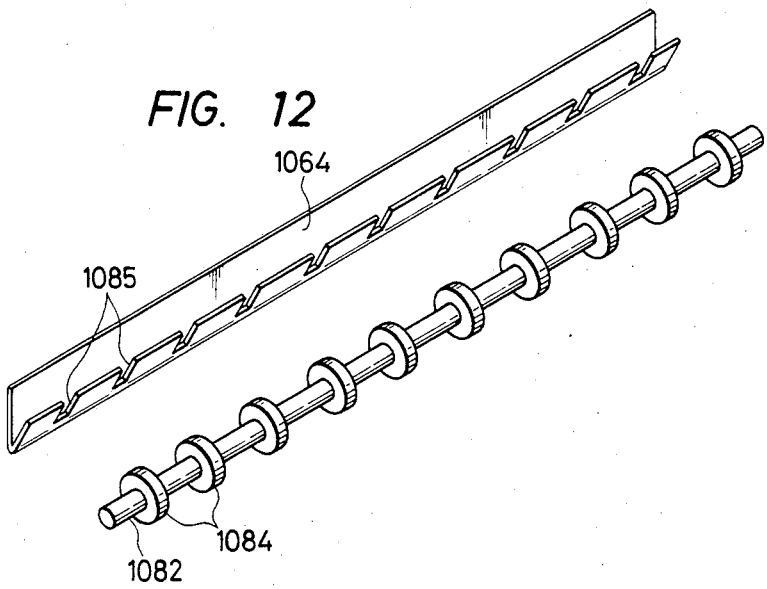
FIG. 12 is an exploded perspective view showing a hook and its fittings.

Both ends of a hook 1064 in the longitudinal direction functioning as a supporting means or mount are attached to the inner chains 1060. The hook 1064 is V-shaped in side view, as shown in FIGS. 7 and 12. One side of the hook 1064 is attached at opposite ends to the inner chains 1060, and the other side of the hook 1064 extends toward the holder 1014. Thus, the lower end of the uppermost one of the photosensitive plates 1016 stacked on the stack holder 1014 can be placed on the hook 1064. The rotary shaft 1054 is provided with a motor 1066 for rotating the rotary shaft 1054 either clockwise or counterclockwise in FIG. 7. Accordingly, when the sprocket wheels 1062 rotate counterclockwise in FIG. 7, the photosensitive plate 1016 on the hook 1064 is lifted, guided by the rotatably fixed rollers 1046, and fed to the automatic processing machine 1012.

The movement of the hook 1064 is limited by limit switches 1058A and 1058B respectively attached near the sprocket wheels 1062 and 1056.

As shown in a front view in FIG. 8, sprocket wheels 1070 and 1072 and 1074 are provided between the side boards 1028 and 1030 and the inner guide boards 1042, and are attached to the shafts 1034, 1038 and 1036, respectively. Outer chains 1076 are provided on the sprocket wheels 1070, 1072 and 1074. A driving force from a motor 1078 connected to the shaft 1038 is applied to the outer chains 1076 so that the outer chains 1076 can turn either clockwise or counterclockwise in FIG. 7.

The outer chains 1076 are guided by outer guide boards 1080 disposed between the shafts 1034 and 1038. The outer guide boards 1080 extend to a position above the shaft 038, are held parallel to the inner chains 1060, and are bent in an arc at a portion above the inner chains 1060 so that their extension line is tangent to the pitch circle of the sprocket wheel 1070.

Further, a plurality of connection shafts 1082 extend between the outer chains 1076. Rotatably fixed rollers 1084, similar to the aforementioned rotatable fixed rollers 1046, are rotatable supported at regular intervals on the connection shafts 1082.

When the connection shaft 1082 having rotatably fixed rollers 1084 are rotated counterclockwise in FIG. 7 under the condition that the lower end of the photosensitive plate 1016 is on the hook 1064, the middle portion of the photosensitive plate 1016 is gradually separated from the stack holder 1014 so that the photosensitive plate 1016 can be transferred onto the rotatable fixed rollers 1046.

As shown in FIG. 12, the hook 1064 is provided with notches 1085 for passing the rotatably fixed rollers 1084 of the connection shaft 1082 therethrough.

To limit the stroke of the outer chains 1076, upper-limit and lower-limit switches 1086 and 1088 are disposed near the sprocket wheels 1070 and 1072, respectively.

Figure 11:
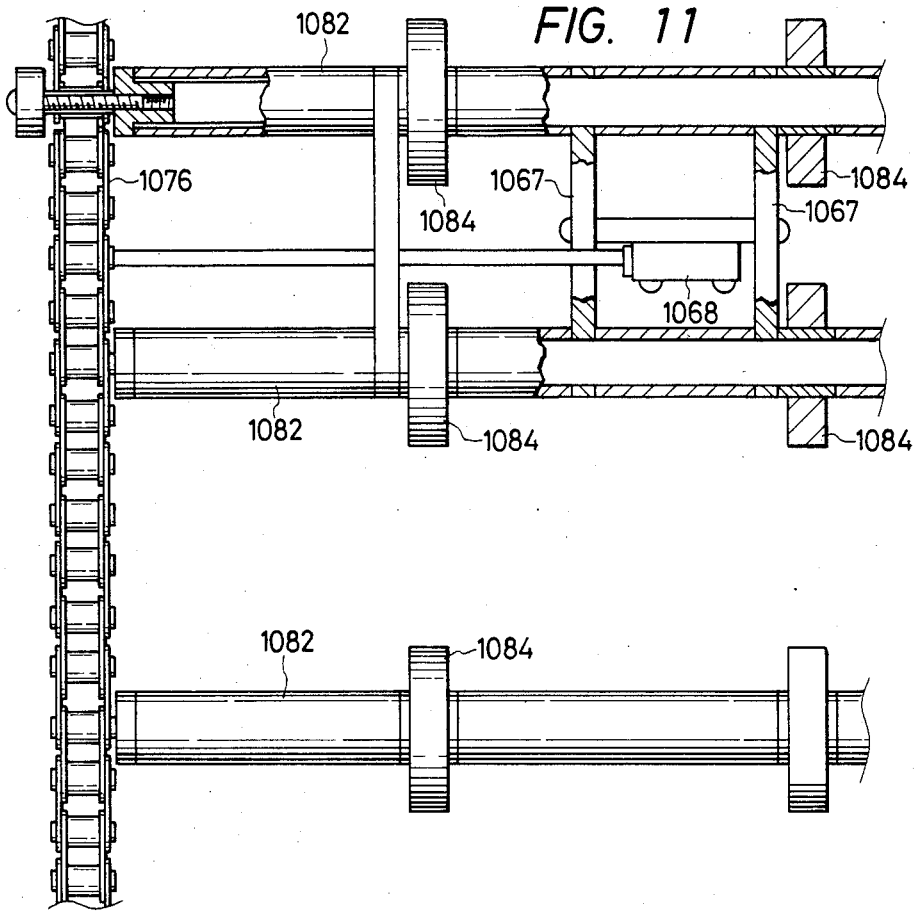
FIG. 11 is a plan view showing a device for detecting the top end of the photosensitive plate, which device is attached to an outer chain.

As shown in FIG. 11, stays 1067 are laid between the first and second connection shafts 1082 attached to the outer chains 1076 moved counterclockwise in FIG. 7. A photosensitive plate detection switch 1068 is attached between the stays 1067. The photosensitive plate detection switch 1068 is a reflection-type optical sensor for detecting the top end of the photosensitive plate 1016 transferred from the stack holder 1014 to the separating-feeding means 1018.

A pair of insertion rollers 1092 and 1094, which constitute a part of the automatic processing machine 1012, are provided adjacent to the sprocket wheels 1070 so as to sandwich the top end of the photosensitive plate 1016 lifted up along the separating-feeding means 1018 between the insertion rollers 1092 and 1094 to thereby feed the photosensitive plate 1016 into the automatic processing machine 1012. For this purpose, the insertion rollers 1092 and 1094 have the substantially same circumferential speed as the developing speed in the automatic developer 1012.

Figure 9:
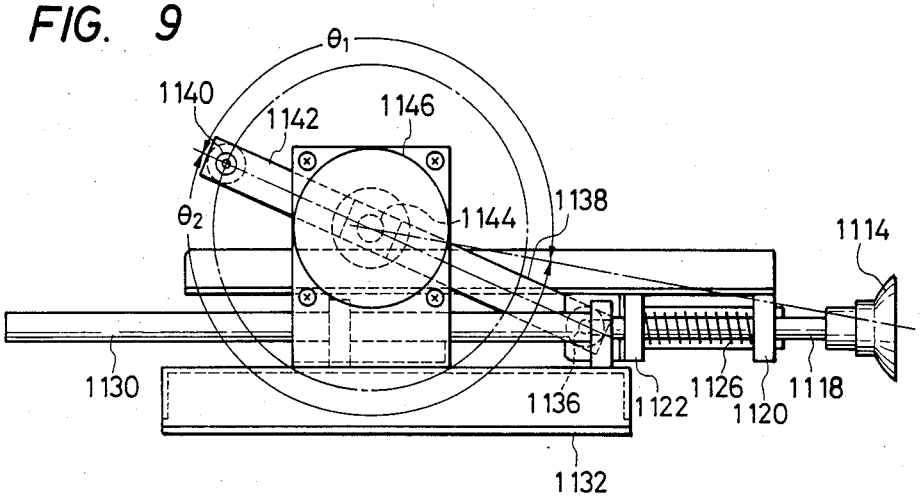
FIG. 9 is a side view of a grasping device in the second embodiment.
Figure 10:
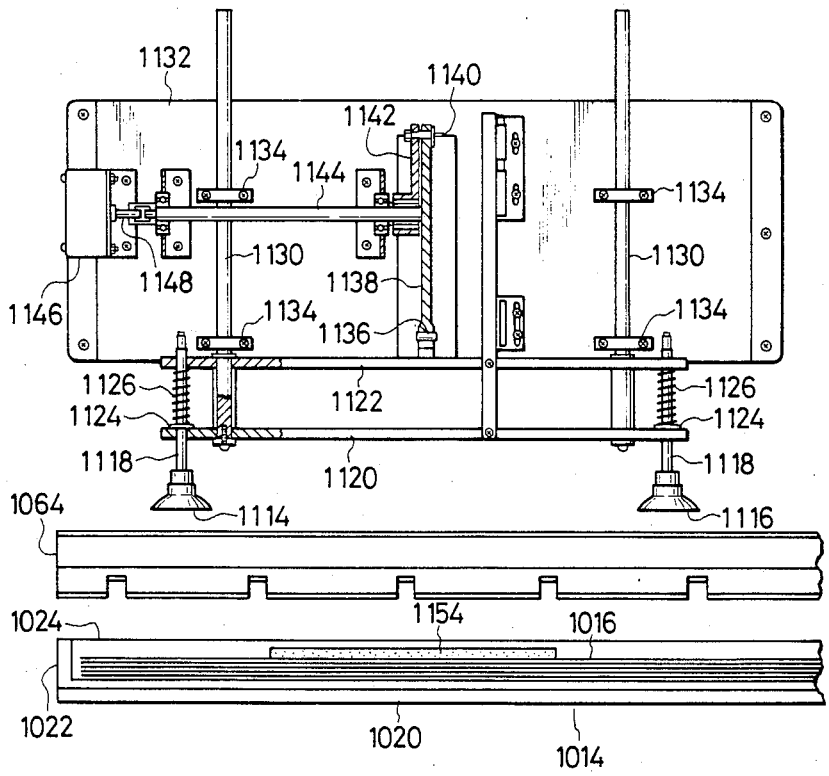
FIG. 10 is a plan view of the transferring device, viewed along a line X—X in FIG. 8.

A transferring means 1112 is provided at a lower portion between the side board 1028 and 1030. As shown in FIGS. 9 and 10, the transferring or transporting device 1112 is provided with a pair of suction cups 1114 and 1116 for attachment to the photosensitive plate 1016. The suction cups 114 and 116 are attached to their top ends to shafts 1118 movable so that the photosensitive plate 1016 can be held by negative pressure transmitted from a negative pressure source (not shown).

The shaft 1118 has an intermediate portion and a top end portion passing through the supporting board 1120 and the supporting board 1122 respectively, and is arranged so as to be slidable relative to the supporting boards 1120 and 1122. An E-shaped cushioning member 1124 is attached to the intermediate portion of the shaft 1118, and a compression coil spring 1126 is interposed between the E-shaped member 1124 and the supporting board 1122. Accordingly, the suction cups 1114 and 1116 are supported by the supporting boards 1120 and 1122, but when the supporting boards 1120 and 1122 are pushed toward the stack holder 1014 to force the suction cups 1114 and 1116 onto the photosensitive plate 1016, the moved supporting boards 1120 and 1122 compress the compression coil spring 1126 so that the suction cups 1114 and 1116 are pressed onto the photosensitive plate 1016 by the elastic force of the compression coil spring 1126.

A push rod 1130 has a top end portion and an intermediate portion fixed to the supporting boards 1120 and 1122, respectively, and is arranged to be slidably guided by a bearing 1134 attached to a base plate 1132.

The respective ends of a long link 1138 are pivotally supported at an intermediate portion of the supporting board 1122 and at one end of a short link 1142 by pins 1136 and 1140. The other end of the short link 1142 is fixed to a rotary shaft 1144, which is connected to a power shaft 1148 of a motor 1146.

Accordingly, the rotation of the motor 1146 is transmitted to rotate the short link 1142, transmitting force to the long link 1138 through the pin 1140 to thereby effect a reciprocating motion of the supporting boards 1120 and 1122 through the pin 1136. In short, a reciprocating slider crank mechanism is formed.

The axial center of the rotary shaft 1144 is arranged out of the extension line in the reciprocating motion of the pin 1136 to thereby form a rapid-feeding mechanism. That is, the forward stroke and backward stroke in the reciprocating motion of the pin 1136 correspond respectively to rotation angles $\theta_1$ and $\theta_2$ of the short links 1142. Accordingly, in the case where the rotary shaft 1144 rotates at a constant velocity, the rotation angle $\theta_1$ corresponds to the forward stroke of the suction cups 1114 and 1116, while the rotation angle $\theta_2$, which is larger than $\theta_1$, corresponds to the backward stroke thereof. Thus, the suction cups 1114 and 1116 can rapidly approach the holder 1014, attach themselves to the photosensitive plate 1016, and relatively slowly carry it toward the hook 1064.

After attaching themselves to the photosensitive plate 1016, the suction cups 1114 and 1116 are freed from the negative pressure under the condition that the photosensitive plate 1016 is moved to a position above the hook 1064. Thus, the lower end of the photosensitive plate 1016 is transferred onto the hook 1064. In this case, only the uppermost one of the photosensitive plates 1016 stacked on the holder 1014 is held by the suction cups 1114 and 1116. However, if the uppermost photosensitive plate 1016 is in close contact with the next photosensitive plate 1016, the adjucent photosensitive plate 1016 in the stack, which is in close contact wih the uppermost photosensitive plate 1016, may be drawn out together with the uppermost photosensitiv plate 1016. To eliminate this possibility, it is preferable that the operation of the suction cups 1114 and 1116 after grasping the photosensitive plate 1016 be halted under the condition that the suction cups are slightly moved to the left in FIG. 7 to thereby establish a time period for the air to pass into the gap between the uppermost and next photosensitive plates 1016 until the next photosensitive plate 1016 slips down the support 1024 from the uppermost photosensitive plate 1016 by force of gravity.

It is further preferable that a tape 1154 having a plurality of small protrusions which contact the edges of the photosensitive plate 1016 be applied to the supporting plate or portion 1024. A material such as "magic" tape (trade name) having a plurality of small flexible protrusions on its upper surface may be used as the tape 1154. The tape 1154 causes a resistance against motion on the lower end of the photosensitive plate 1116 grasped by the suction cups 1114 and 1116, so that the uppermost photosensitive plate 1016 can be separated from the next photosensitive plate 1016 which is in close contact with the uppermost photosensitive plate 1016 but which is not held by the suction cups.

It is apparent from FIG. 8 that the distance between the suction cups 1114 and 1116 is less than half the width of each of the separating-feeding means or device 1018 and the holder 1014 and corresponds to a minimum-sized one of the photosensitive plates 1016. Although it is preferable for the purpose of grasping large-sized photosensitive plate 1016 that the number of suction cups or the distance between the suction cups 1114 and 1116 be increased, there exists a problems in that an uppermost narrow photosensitive plate 1016 will be grasped together with a next wider photosensitive plate 1016 when separated from the holder 1014. Hence, the distance between the suction cups 1114 and 1116 is determined in accordance with the minimum size.

Further, it is preferable that the tape 1154 cover the supporting plate or portion 1024 corresponding to the space between the suction cups 1114 and 1116 as shown in FIG. 10. If the tape 1154 is placed out of the space between the suction cups 1114 and 1116, resistance to the motion of the photosensitive plate 1016 grasped by the suction cups 1114 and 1116 occurs with respect to the photosensitive plate 1016, thereby increasing the amount of bending of the opposite ends of the photosensitive plate 1016 (in plan view). This creates a problem in that the strongly bent ends of the photosensitive plate 1016 cannot be received on the hook 1064.

Subsequently, the operation of this embodiment will be described in detail.

In the initial operating state shown in FIG. 7, the hook 1064 is at the side of the sprocket wheel 1062 and faces the stack holder 1014, and the outer chain 1076 is in the state where the front most roller 1084 rotatably fixed on the shaft 1082 is at the side of the hook 1064.

A plurality of exposed photosensitive plates 1016 are stacked substantially vertically on the holder 1014.

In the transporting or transferring device 1112, the suction cups 1114 and 1116 are projected to the right in FIG. 7 by the rotation of the motor 1146 at an angle $\theta$hd 1 to grasp the lower end portion of the uppermost photosensitive plate 1016 stacked on the holder 1014. After grasping the plate 12016, the suction cups 1114 and 1116 are returned to the left in FIG. 7 by rotation of the motor through an angle $\theta_2$, becoming free of the negative pressure at a position above the hook 1064. As a result, the uppermost photosensitive plate 1016 is dropped so that the lower end thereof rests on the hook 1064.

At this time, the motor 1078 is operated to turn the outer chain 1076 counterclockwise in FIG. 7. Accordingly, the rollers 1084 are successively lifted at the plate side (the right side in FIG. 7) of the uppermost photosensitive plate 1016 having its lower end held by the hook 1064, so that the photosensitive plate 1016 is separated from the holder 1014 gradually and moved up to the upper portion of the separating-feeding means 1018. The reverse side of the photosensitive side of the photosensitive plate 1016 is in contact with the rotatably fixed rollers 1046.

In this condition, the lower end of the photosensitive plate 1016 is received on the hook 1064, which remains stationary. Hence, the photosensitive plate 1016 can be securely supported even when the shafts 1082 are lifted. In this case, since it is unnecessary that the suction cups 1114 and 1116 would hold the photosensitive plate 1016 before the lower end of the photosensitive plate 1016 reaches the hook 1064, the force of the suction cups 1114 and 1116 for grasping the photosensitive plate 1016 can be decreased, in comparison with the case where the hook 1064 is attached to the outer chain 1060 or, in other words, that the inner chain 1060 is omitted.

The photosensitive plate detection switch 1068 guided by the leading roller 1084 and lifted along the photosensitive side of the photosensitive plate 1016, detects the upper end of the photosensitive plate 1016, whereupon the motor 1066 is operated to rotate the inner chain 1060 counterclockwise in FIG. 7 at the same velocity as that of the outer chain 1076. As a result, the hook 1064 is lifted together with the photosensitive plate 1016. Thus, the upper end of the photosensitive plate 1016 is sandwiched between the leading roller 1084 and the roller 1046 and gradually horizontally bent along the outer guide portion 1080. Thus, the photosensitive plate 1016 is passed so as to be inserted between the insertion rollers 1092 and 1094.

In this embodiment, it is preferable for the speed of the motors 1078 and 1066 to be reduced to a slow speed when the leading roller 1084 is detected by the upper-limit switch 1086 immediately before the top end of the photosensitive plate 1016, rapidly lifted up by the motors 1078 and 1066, reaches the insertion rollers 1092 and 1094. By such speed control, the total operation time can be shortened. The speed after reduction should be lower than the rotational speed of the insertion rollers 1092 and 1094 so that the top end of the photosensitive plate 1016 can be fed smoothly.

When the top end of the photosensitive plate 1016 is sandwiched between the insertion rollers 1092 and 1094, the motor 1066 is reversed to rotate the inner chain 1060 clockwise in FIG. 7 and stop the hook 1064 in the state shown in FIG. 7. The reverse rotation of the motor 1066 is started a predetermined time after the guide ring 1084 is detected by the upper-limit switch 1086. On the other hand, the outer chain 1076 is stopped before the rear end of the fed photosensitive plate 1016 has passed through the sprocket wheel 1056 to thereby prevent the rear end of the photosensitive plate 1016 from touching the next photosensitive plate 1016 stacked on the holder 1014 because of the straight state of the photosensitive plate 1016 due to its stiffness. The outer chain 1076 is thus reversed to return the leading guide ring 1084 to the condition shown in FIG. 7 to prepare for grasping the next photosensitive plate 1016. Preferably, the operation of stopping and reversely rotating the outer chain 1076 is started a predetermined time delay after the rotatably fixed rollers 1084 of the connection shaft 1082 is detected by the upper-limit switch 1086.

As described above, the hook 1064 and the guide ring 1084 are separately operated by the inner chain 1060 and the outer chain 1076. Accordingly, in this case, the hook and the guide ring can be rapidly operated, thereby making it possible to shorten the work cycle in comparison with the case where the outer chain 1076 and the inner chain 1060 are implemented with a single chain to which the hook 1064 and connection shafts 1082 and guide rings or rollers 1084 are attached. Specifically, when a small sized photosensitive plate 1016 is fed, since it is unnecessary that for the leading roller 1084 to pass through the sprocket wheel 1070, the chain can be returned before the small-sized photosensitive plate 1016 has completely emerged from the insertion rollers 1092 and 1094, and thus the work cycle is shortened.

Further, in order to stack the photosensitive plates 1016 on the holder 1014 easily, a rotary shaft may be provided to rotate the frame 1020 around the left or right end of the frame 1020 to thereby spread the distance between the holder 1014 and the separating-lifting device 1018.

As described above, the present invention provides a photosensitive plate autofeeder for feeding exposed photosensitive plates to an automatic processing machine or developer, which includes a photosensitive plate holder for vertically holding a plurality of photosensitive plates, a supporting device disposed in opposition to the holder for supporting a lower end of a photosensitive plate, a transport device for transferring the lower end of the uppermost one of the photosensitive plates from the holder to the supporting device, a separating device which is lifted between the supporting means and the holder for separating the upper-most one of the photosensitive plates from the holder, and a lifting device driven separately from the separating device for lifting the supporting device to thereby feed the uppermost photosensitive plate separated from the holder to the automatic developer with the upper end of the photosensitive plate at the head. Accordingly, the invention has an excellent effect in that photosensitive plates can be rapidly fed to the automatic developer while only requiring a small space for installation of the autofeeder.

What is claimed is:

1. A photosensitive plate autofeeder for feeding exposed photosensitive plates to an automatic processing machine, said feeder comprising:

a photosensitive plate stack holder for holding a substantially vertically arranged stack of said photosensitive plates;

photosensitive plate separating means movable from a first position to a second position for separating said photosensitive plates;

detecting means for detecting separation of said photosensitive plate;

photosensitive plate transferring means for grasping a lower end portion of an uppermost one of said photosensitive plates on said photosensitive plate stack holder so as to successively transfer said photosensitive plates one by one from said photosensitive plate stack holder to said photosensitive plate separating means;

photosensitive plate releasing means for releasing the photosensitive plates successively from the grasp of said transferring means in response to detection of separation of the photosensitive plate from said photosensitive plate stack holder by said photosensitive plate separating means;

photosensitive plate guiding means;

photosensitive plate conveying means movable from a first location to a second location for conveying the photosensitive plate to said automatic processing machine along said plate guiding means in response to detection of release of the photosensitive plate from said photosensitive plate transferring means; and driving means for reciprocatably driving said separating means between said first and second positions and said conveying means between said first and second locations.

2. The photosensitive plate autofeeder according to claim 1, in which said plate guiding means comprises a plurality of fixed rotatable rollers arranged so as to form an arc, and in which said photosensitive plate conveying means comprises a pair of chains arranged in parallel, at least one intermediate roller interposed between said chains, and a lower end supporting portion provided with a force hook for supporting the rear end edge of the photosensitive plate.

3. The photosensitive plate autofeeder according to claim 1, in which said photosensitive plate separating means comprises a roller interposed between a pair of parallel disposed chains at a leading portion in the direction of movement of said chains.

4. The photosensitive plate autofeeder according to claim 1, in which said transferring means comprises at least one suction cup attached to a large-diameter attaching portion formed at a forward end portion of a piping portion connected to a suction pump, at least one groove being formed in an inner surface of said attaching portion and extending in an axial direction thereof, and a ball disposed movably in said axial direction within said attatching portion.

5. A photosensitive plate autofeeder for feeding exposed photosensitive plates to an automatic processing machine, said autofeeder comprising:

a photosensitive plate holder for holding a substantially vertically arranged stack of said photosensitive plates;

supporting means for supporting a lower end of said photosensitive plate;

transferring means for transferring a lower end of an uppermost one of said photosensitive plates from said holder to said supporting means;

separating means drivable between said supporting means and said holder to separate the uppermost one of said photosensitive plates from said holder;

photosensitive plate conveying means for lifting said supporting means to thereby feed the uppermost photosensitive plate separated from said holder to said automatic processing machine with the upper end of said photosensitive plate at the head; and a driving mechanism for driving said separating means and said conveying means, said driving mechanism including means for driving said conveying means independently of said separating means.

6. The photosensitive plate autofeeder of claim 5, wherein said supporting means comprises a force hook for supporting the lower end edge of the photosensitive plate transferred with said transferring means, said conveying means comprises a pair of first chains arranged in parallel, and said separating means comprises a pair of second chains arranged in parallel and at least one shaft member interposed between said second chains.

7. The photosensitive plate autofeeder of claim 6, further comprising means for detecting separation of the one photosensitive plate from said holder, and said second means for driving said conveying means is responsive to said detection of separation.

8. The photosensitive plate autofeeder of claim 7, wherein said conveying means moves said supporting means at the same speed as said separating means.

9. The photosensitive plate autofeeder of claim 8, further comprising plate guiding means having a plurality of fixed shafts and a plurality of guide rollers rotatably provided on said fixed shafts, wherein said separating member has a plurality of rollers rotatably fixed to said shaft member, said guide rollers of said plate guiding means and rollers of said separating means holding the photosensitive plate supported on said supporting means therebetween to feed the photosensitive plate to said automatic processing machine while both said separating means and said conveying means are being driven.

10. The photosensitive plate autofeeder of claim 9, further comprising switching means for detecting completion of conveying of said photosensitive plate to cause said drive mechanism to move said conveying means in a reverse direction at a predetermined time delay after the detection, and for causing said drive mechanism to move said separating means in a reverse direction at another predetermined time delay after the detection.

11. The photosensitive plate autofeeder of claim 9, wherein said transferring means comprises a suction cup for grasping the photosensitive plate, said suction cup being connected to a suction pump, and a reciprocating slide crank mechanism for effecting reciprocating motion of said suction cup.

12. The photosensitive plate autofeeder of claim 9, wherein said transferring means comprises at least two suction cups for grasping the photosensitive plate, and wherein said suction cups are aligned at an interval corresponding to the minimum size of said photosensitive plates to be positioned at one end of the photosensitive plate conveying means.

13. The photosensitive plate autofeeder of claim 5, wherein a supporting plate of the photosensitive plate stack holder has a plurality of small flexible protrusions on its upper surface.

14. A photosensitive plate autofeeder for feeding exposed photosensitive plates to an automatic processing machine, said autofeeder comprising:

a photosensitive plate holder for holding a substantially vertically arranged stack of said photosensitive plates;

supporting means for supporting a lower end of said photosensitive plates;

transferring means for transferring the lower end of an upppermost one of said photosensitive plates from said holder to said supporting means;

separating means movable from a first position to a second position to separate the uppermost one of said photosensitive plates from said holder;

photosensitive plate conveying means movable from a first location to a second location for moving said supporting means to thereby feed the uppermost photosensitive plate separated from said holder to said automatic processing machine with the upper end of said photosensitive plate at the head; and driving means for reciprocatably driving said separating means between said first and second positions and said conveying means between said first and second locations.

* * * * *